US005343637A

United States Patent [19]

Schindler

[11] Patent Number: 5,343,637

[45] Date of Patent: Sep. 6, 1994

[54] SHOE AND ELASTIC SOLE INSERT THEREFOR

[76] Inventor: Jerry Schindler, 757 Spartan Dr., Rochester Hills, Mich. 48063

[21] Appl. No.: 933,885

[22] Filed: Aug. 21, 1992

Related U.S. Application Data

[63] Continuation of Ser. No. 824,701, Jan. 21, 1992, abandoned, which is a continuation of Ser. No. 587,522, Sep. 24, 1990, abandoned, which is a continuation of Ser. No. 287,458, Dec. 21, 1988, abandoned.

[51] Int. Cl.[5] ..... A43B 13/18; A43B 13/28

[52] U.S. Cl. ..... 36/28; 36/27; 36/7.8; 36/38

[58] Field of Search ..... 36/28, 27, 7.8, 37, 36/38; 267/161, 166.1, 181, 163, 158, 159, 166

[56] References Cited

U.S. PATENT DOCUMENTS

| | | | |
|---|---|---|---|
| 413,693 | 10/1889 | Walkers . | |
| 507,490 | 10/1893 | Gambino . | |
| 968,020 | 8/1910 | Yandoli . | |
| 1,088,328 | 2/1914 | Cucinotta | 36/28 |
| 1,883,249 | 10/1932 | Spencer | 267/159 |
| 2,308,695 | 1/1943 | Johnson | 567/163 |
| 2,516,236 | 7/1950 | Moorhead et al. | 267/159 |
| 2,668,374 | 2/1954 | Seigle | 36/28 |
| 2,710,460 | 6/1955 | Stasinos . | |
| 2,947,529 | 8/1960 | Schwartz et al. | 267/161 |
| 3,239,804 | 3/1966 | Ezskamp et al. | 267/161 X |
| 3,317,166 | 5/1967 | Janssen | 267/158 |
| 3,317,837 | 5/1967 | Takeda | 267/163 |
| 3,602,490 | 8/1971 | Mueller | 267/161 |
| 4,267,648 | 5/1981 | Weisz . | |
| 4,283,864 | 8/1981 | Lipfert | 36/28 |
| 4,322,893 | 4/1982 | Halrorsen . | |
| 4,457,084 | 7/1984 | Huribata et al. | 36/7.8 |
| 4,685,094 | 8/1987 | Vitringa et al. | 267/181 X |
| 5,149,150 | 9/1992 | Davis | 267/159 |

FOREIGN PATENT DOCUMENTS

| | | | |
|---|---|---|---|
| 0186138 | 7/1990 | Japan | 267/166.1 |
| 0014930 | 1/1991 | Japan | 267/181 |
| 105409 | 4/1917 | United Kingdom | 36/37 |
| 608180 | 8/1948 | United Kingdom | 36/28 |

*Primary Examiner*—Paul T. Sewell
*Assistant Examiner*—Marie D. Patterson
*Attorney, Agent, or Firm*—C. J. Fildes & Co.

[57] ABSTRACT

A shoe having an outer sole, an upper attached to the outer sole for enclosing the wearer's foot, and an insole. A compressible and expansible elastic insert is accommodated in a cavity between the outer sole and the insole. The elastic insert has a flat body formed of spring material. Projecting out of the plane of the body is a spiraling, tapering leaf which elastically deflects in response to relative movements of the outer sole and the insole toward and away from one another.

19 Claims, 2 Drawing Sheets

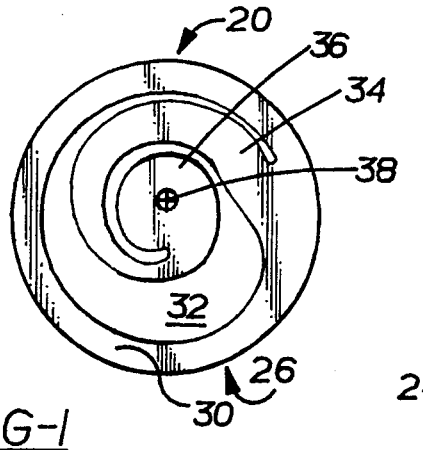
FIG-1
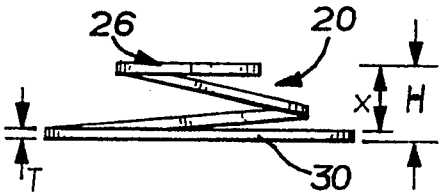
FIG-2
FIG-4
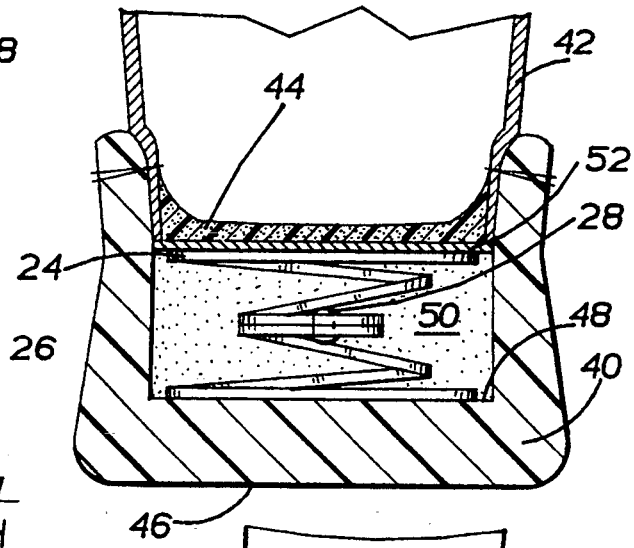
FIG-3
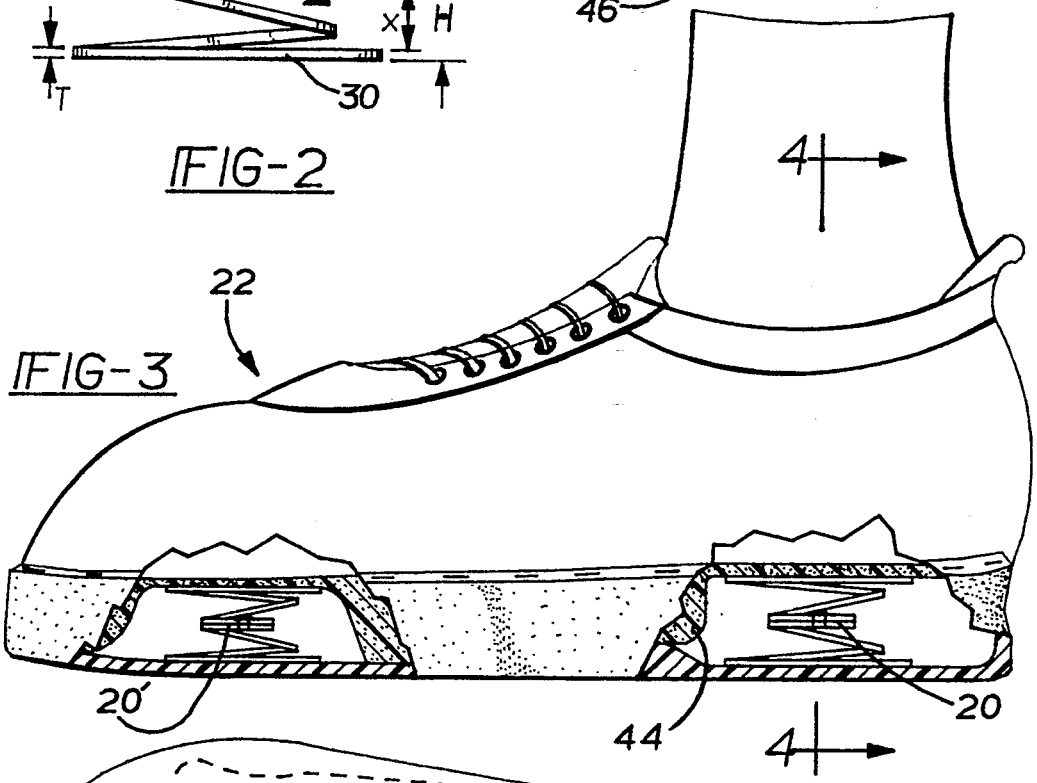
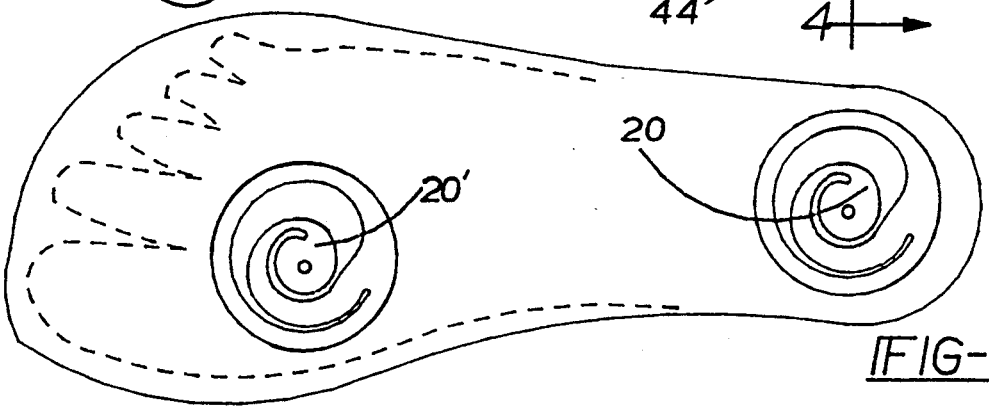
FIG-5

SHOE AND ELASTIC SOLE INSERT THEREFOR

This is a continuation of copending application(s) Ser. No. 824,701 filed on Jan. 21, 1992; which is a continuation of Ser. No. 07/587,522 filed Sep. 24, 1990 which is a continuation of Ser. No. 07/287,458 filed Dec. 21, 1988, all now abandoned.

FIELD OF INVENTION

The present invention relates to the field of footwear and particularly to footwear having an elastic sole insert.

BACKGROUND OF INVENTION

Sporadically over the last 100 years, there have been various attempts to fabricate shoe soles or insoles having internal springs. Early such devices are shown in U.S. Pat. Nos. 413,693, 507,490, 968,120, and 1,088,324. These early patents, like the more recent counter-part, U.S. Pat. No. 4,322,893, utilize helically wound coil springs as shock absorbing energy storage devices. A draw back with coil springs is their height relative to their diameter and their limited range. In order to minimize the collapsed height, conically wound coil springs have been utilized. The most significant problem of prior art coil springs is their limited energy storage capacity. Additionally, coil springs of conventional design are difficult to retain as their free ends cause load concentrations requiring rigid retainer plates as reinforcement structures, as shown in U.S. Pat. No. 2,668,374. U.S. Pat. No. 4,267,648 (Weisz) suggests several alternatives to coil springs, such as flat disk springs and belleville washer springs. In order to maintain a low profile, a large number of small springs are utilized.

OBJECTS, FEATURES AND ADVANTAGES OF INVENTION

It is an object of the present invention to provide an elastic sole insert which is compact and provides high energy storage capability.

A feature of the present invention is that the insert has a large diameter relative to its height and presents a large load bearing surface.

An advantage of the present invention is the elastic insert is relatively easy to retain within the shoe, and has a relatively low weight and size when compared to prior art devices having comparable energy storage capacity.

These and other objects, features and advantages of the present invention will become apparent from the following specification.

SUMMARY OF INVENTION

Disclosed is a shoe having an outer sole member, an upper member attached to the sole for enclosing the foot of the wearer, and an insole which confronts the wearer's foot. An elastic insert is placed in a cavity in the shoe between the outer sole and the insole. The elastic insert deforms along an axis generally perpendicular to the sole of the shoe. The elastic insert has a generally planar body and a cutout region formed therein which defines a spring leaf. In its unstressed condition the leaf is inclined out of the plane of the body, but elastically deflects toward the plane of the body when loaded in compression.

BRIEF DESCRIPTION OF DRAWINGS

FIG. 1 is a plan view of an elastic insert;

FIG. 2 is a side elevational view of the insert of FIG. 1;

FIG. 3 is a partially cut-away side elevation of a shoe with a wearer's foot shown in outline;

FIG. 4 is a cross sectional end view taken along line 4—4 of FIG. 3;

FIG. 5 is a plan view of the outline of a shoe showing the insert orientation;

DESCRIPTION OF THE PREFERRED EMBODIMENT

Figure 6:
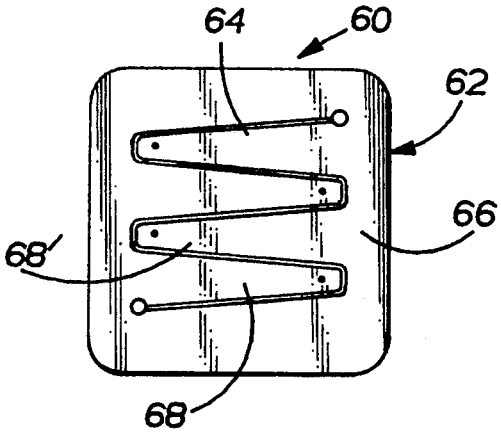
FIG. 6 is a plan view of an alternative elastic insert design.

With reference to the drawings, several preferred embodiments of the invention are disclosed. FIGS. 1–5 show a first embodiment of the elastic insert 20 shown in an athletic shoe 22. In the preferred embodiment, the elastic insert 20 consists of upper and lower elements 24 and 26 shown in FIG. 4 oriented in stacked alignment along a common axis. Upper and lower elements 24 and 26 are substantially identical to one another and are centrally attached to one another using a rivet 28 or the like which acts as a fastener means for attaching the upper and lower elements together. Each of the upper and lower elements is formed of an elastically deformable material such as a spring steel sheet or the like. Each element has a continuous and generally planar, circular body 30 having a cutout region 32 formed therein which defines a spring leaf 34. The leaf is joined at one end to the body adjacent its peripheral edge and extends inwardly wholly within the confines of the periphery of the body. The leaf preferably is of spiral shape, as shown in the FIG. 1 plan view. The leaf is joined at its inner end to an enlargement constituting a bearing portion 36 having a central hole 38 for receiving rivet 28.

As shown in the FIG. 2 side elevation, the body 30 is generally planar. Leaf 34 is inclined and projects in a direction out of the plane of the body in the uncompressed state. The sheet material forming the element 26 has a substantially uniform thickness T, and the element itself has a free or uncompressed height H as shown. The maximum deflection is the difference between the free height H and thickness T. The elastic element may be compressed repeatedly from its free height to the totally flat position without fatigue.

Leaf 36 acts as a cantilever beam fixed at one end and loaded at the other. The leaf is joined at its outer end to the body adjacent its periphery and extends inwardly therefrom. The leaf has a uniform thickness T and a varying width. The leaf has a width that is greatest adjacent its juncture with the body 30, and tapers to a minimum width adjacent the bearing portion 36. By utilizing a spiral design, a greater beam length can be achieved. The spiral design causes the leaf to be loaded in torsion, as well as simply in shear and bending, as would be the casé in a straight cantilever beam affixed to a rigid body at one end. The spiral configuration preferably is nautiliform in configuration. Where the elastic insert is made up of an upper and lower element as shown in FIG. 4, the free height, compressed thickness, and useful range will be twice that of the single element.

Shoe 22 is made up of a sole member 40, an upper member 42 and an insole 44. Sole 40 has an exterior surface 46 and an interior surface 48. The upper member 42 is affixed to the periphery of the sole and generally encloses the foot of the wearer in a conventional manner. Insole 44 conforms to the sole interior surface and cooperates with the foot of the shoe wearer in the conventional manner. Between the sole interior and the insole is a cavity 50 in which the elastic insert 20 is accommodated. As the foot of the shoe wearer exerts a compressive force on the bearing portion 36, leaf 34 will elastically deflect toward the plane of the body 30. As the shoe wearer runs or jumps, the load exerted upon the insert will cause the insert alternately to compress and expand, storing and releasing energy. In the preferred embodiment of the invention shown in FIG. 4, a thin insole reinforcement 52 is provided to prevent the soft foam insole 44 from deforming into the element cutout region 32.

The elastic insert is particularly beneficial in an athletic shoe used in jumping sports, such as basketball and volleyball. The inserts are also helpful in running shoes. During a running or jumping step, the load is transmitted from the wearer's foot to the ground through the shoe sole. In a typical shoe during a jumping maneuver, the sole is compressed during initiation of the jump and expands to the original height once the shoe is separated from the ground. A typical shoe sole is relatively inelastic and is very inefficient at releasing energy during the jumping maneuver due to high hysteresis. Inserts according to the invention are very elastic with relatively little hysteresis thereby releasing the maximum amount of energy during a jumping maneuver.

Preferably, each shoe is provided with two elastic inserts spaced longitudinally of the shoe, as shown in FIGS. 3 and 5. One insert 20 located in the shoe sole cavity adjacent the wearer's heel and the other insert 20' oriented in a cavity below the ball of an wearer's foot.

Initial testing has indicated that the elastic element having a compression range of 0.27 inch and a spring rate of 175 pounds per inch performs satisfactorily in a shoe worn by a 160 pound person. Ideally, an insert will be selected which has the highest spring rate possible and which will still enable the insert to be fully compressed at the commencement of the muscle contraction or positive movement portion of the jumping maneuver. Too stiff an insert will not enable the insert to be fully compressed during the muscle extension or negative movement portion of the jump. If the spring is not fully compressed at the commencement of the muscle contraction, jumping performance can actually be hindered as a result of the inserts limiting the force which can be exerted during a portion the muscle contraction. Too soft an insert will not store the maximum amount of energy, therefore limiting the beneficial effect of the insert and possibly resulting in excess deformation during normal walking. While ideally the insert spring rate would be specifically selected for each wearer considering the wearer's weight and athletic ability, commercial shoes having permanently installed inserts can be made with regular or stiff inserts. Spring rate of the inserts would also vary as a function of shoe size.

For jumping sports it is believed that ball and heel elastic elements should have a substantially equal geometry and spring rate. It should be recognized that the heel and ball spring rates can be varied as desired depending upon the expected use of the shoe. It should also be appreciated that only a single insert may be used in certain circumstances. For example, a long-distance running shoe may utilize a heel insert only while the sprinter's shoe may utilize a ball insert only.

Figure 7:
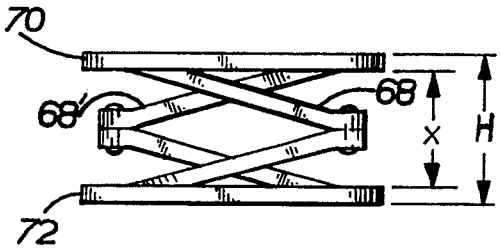
FIG. 7 is a side elevation of the insert in FIG. 6 in its free state.
Figure 8:
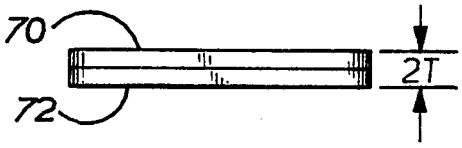
FIG. 8 is a side elevation of the insert shown in FIG. 6 in its fully compressed state.

A second embodiment 60 of the elastic insert is shown in FIGS. 6–8. The insert is formed of a substantially planar, rectangular body sheet 62 having a cutout 64 formed therein which defines a peripheral edge 66 and a plurality of spring leaves 68, 68', 68'', 68''' projecting inwardly from opposite sides of the body 62. The insert is preferably made up of upper and lower elements 70,72 as shown in FIG. 7. The peripheral edge 66 of each body is generally planar and parallel to the shoe sole. The element is elastically deflectable along an axis generally perpendicular to the shoe sole. The leaves of each element project out of the plane of the body in the free state as shown in FIG. 7 and the free ends of the leaves of one element overlie and engage the leaves of the other element. The ends of the leaves are locally parallel as shown, to form bearing portions.

Preferably, as in the first embodiment, the leaves of the upper and lower element are fastened together at their bearing portions using a suitable fastener such as a rivet or the like. Also similar to the first embodiment, the elastic element has a fully compressed height equal to two times the sheet thickness T, and the leaves are generally tapered having a width greatest at their juncture with the marginal edge of the body 62.

Figure 9:
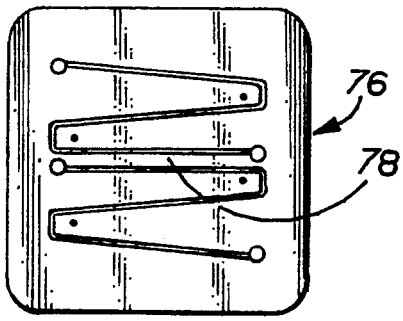
FIG. 9 is a plan view of a third embodiment of the elastic insert, the side elevation in the free and compressed states being substantially equivalent to FIGS. 7 and 8, respectively.

A third embodiment of the elastic insert 76 is shown in FIG. 9. The difference between insert 76 and insert 60 is web 78 which extends across the insert body and connects opposite marginal edges of the element to one another. It should be appreciated that a wide variety of leaf configurations can be constructed by providing one or more cutouts of various shapes to suit the desired application.

Figure 10:
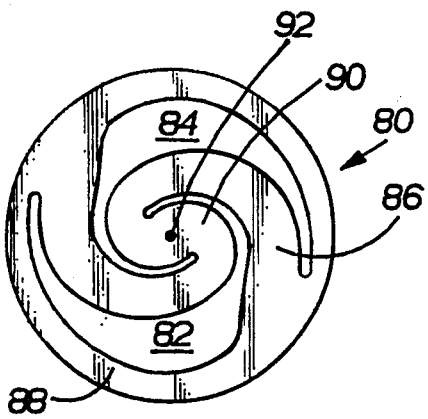
FIG. 10 is a plan view of a fourth embodiment of the elastic insert.
Figure 11:
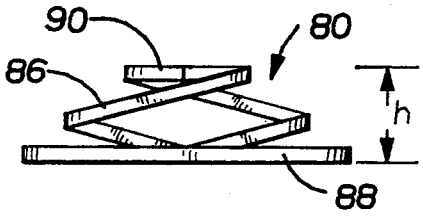
FIG. 11 is a side elevation of the FIG. 10 elastic insert.

A fourth embodiment of the elastic insert 80 is shown FIGS. 10 and 11. Preferably, insert 80 is made up of upper and lower elements in a similar fashion as the earlier embodiments described. Insert 80 is similar in appearance to insert 20 shown in FIGS. 1 and 2. A first and a second cutout region 82 and 84 is formed in the elastic insert to define a pair of spiraling leaves 86 each of which is joined at one end to the body 88. The opposite end of each is joined to a central bearing portion 90 having a hole 92 therein for the accommodation of a rivet or the like. Each leaf is widest at its juncture with the body 88 and tapers in a direction toward the bearing portion 90.

Figure 12:
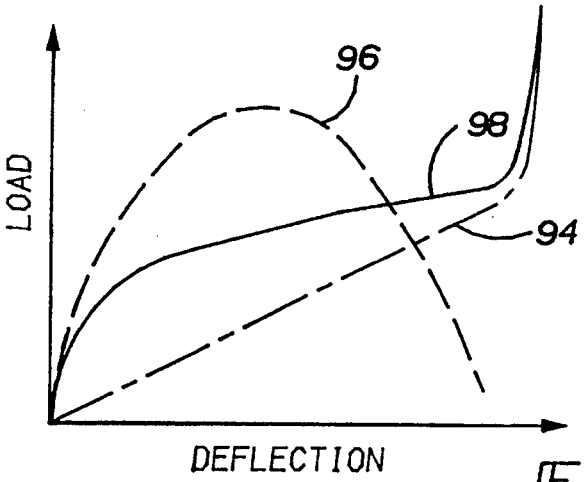
FIG. 12 is a load versus deflection graph.

Elastic element 80 exhibits significantly different load versus deflection characteristics than previously described elastic elements utilizing leaves of cantilever design. Leaves of cantilever design have a fairly linear load versus deflection curve as shown on line 94 in FIG. 12. In order to increase the energy storage capacity of the elastic insert given maximum load, a non-linear load versus deflection curve is preferred and which has an initially steep slope and a very low slope high deflection. Elastic element 80 combines the load versus deflection characteristics of the spring as is shown in curve 94 with that of a dome spring or belleville washer represented by curve 96 to achieve the load versus deflection curve represented by line 98.

Figure 13:
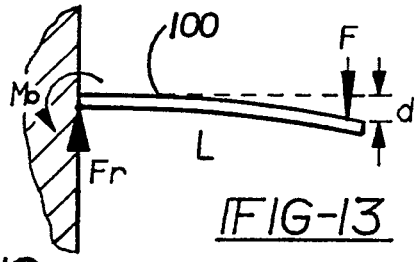
FIG. 13 is a schematic diagram of a cantilevered beam.

FIG. 13 shows a schematic representation of a cantilever beam affixed at one end and loaded at the other. Beam 100 has a length 1. When force F is exerted on the free end of the beam, the free end deflects a distance d. Deflection in the classical cantilever beam shown in FIG. 13, is expressed by the following equation:

$$d=Fl^3/3EI$$

Where E is equal to the modulus of elasticity and I is the beam moment of inertia. Force F exerted on the end of the beam causes an equal and opposite reaction force $F_R$ at the wall attachment. Force F also causes a bending moment $M_0$ to be exerted at the wall attachment, where $M_0$ equals Fl. While the shear load on the beam is uniform throughout its length, the moment varies directly in proportion to the length. At the wall, bending moment is maximum, at the free end the bending moment is zero with a linear progression therebetween. The bending load exerted on the beam will therefore be greatest adjacent the affixed attachment, and minimum at the free end.

In order to prevent stress concentration, and to minimize the weight of the insert, in the various preferred embodiments, the leaves are generally tapered, being widest adjacent their juncture with the body, and narrowest adjacent the bearing portion. This tapered leaf design results in a substantially uniform stress distribution. Beam 68 in insert 60 shown in FIG. 6 acts like a classical cantilever beam as shown in FIG. 13, with the exception that its width and moment of inertia vary as a function of length. The beam is loaded in both the bending and shear modes. The spiral leaf design incorporated in the inserts shown in FIGS. 1–5, 10, and 11 is also loaded in torsion. The relative magnitude of the bending in the torsional load varies throughout the beam length as a function of geometry. In the embodiment of the insert shown in FIG. 1, over two-thirds of the energy is stored in the spring as a result of torsional deformation. In insert 80, in addition to sheer, bending and torsion, the beam is also loaded in axial compression.

As a result of forming the insert from a sheet of material having an uniform thickness, the leaf between its juncture with the body and the bearing portion will have a generally rectangular cross-sectional area whose width is substantially greater than its thickness. The rectangular shape enables the polar moment of inertia of the leaf cross-section to be maximized to better resist torsion in the spiral insert designs shown in FIGS. 1 and 10.

The elastic inserts in the preferred embodiment can be fabricated of high quality spring steel, such as SAE 9254, SAE 1074 or equivalent, but it should be appreciated that other materials could be used. Common spring materials and their properties are listed in Mark's Standard Handbook for Mechanical Engineering, 8th Edition, pages 8–78, which is incorporated by reference herein. Other material, such as titanium sheet or molded fiber reinforced composites, could also be used in applications where weight is critical.

In order to manufacture an elastic insert, flat plate stock, such as spring steel stock having the appropriate thickness is selected. While the steel is in the annealed state, it is cut to the desired plan view using a milling or stamping operation. Preferably, the insert is de-burred to remove sharp corners. The leaf is then plastically deformed out of the plane of the body to achieve the desired free height. The elastic insert element is then heat treated using conventional quenching techniques to harden the spring. In the preferred embodiment where the elastic insert is made up of a pair of elements, the two elements are axially aligned with their leaves engaging one another and fastened together using a rivet or the like.

It is also to be understood, of course, that while the forms of the invention herein shown and described constitute preferred embodiments of the invention, this disclosure is not intended to illustrate all possible forms of the invention. It will also be understood that the words used are words of description rather than limitation, and that various changes may be made without departing from the spirit and scope of the invention disclosed.

I claim:

1. A shoe adapted to be worn on a foot of a person, said shoe comprising:

a. an outer sole having a peripheral edge;

b. an upper fixed to the periphery of said sole for enclosing the foot of the person;

c. an insole overlying said outer sole in spaced relation thereto to form a cavity between said outer sole and said insole, said cavity having substantially flat, opposed surfaces, said outer sole and said insole being relatively movable toward and away from one another; and d. a spring member accommodated in said cavity and engagable with said outer sole and said insole for yieldably resisting relative movement of said outer sole and said insole toward one another, e. said spring member comprising a unitary, substantially planar body of uniform thickness, springy material seated on one surface of said cavity and having a peripheral edge, f. a leaf cut from said body and joined at one end to said body adjacent said edge, g. said leaf when in its unstressed condition being inclined outwardly of the plane of said body for engagement by the other surface of said cavity, h. said leaf having a bearing portion remote from said one end of said leaf and which in the unstressed condition of said leaf occupies a position of maximum spacing of said leaf from the plane of said body, i. said leaf being resiliently deformable in response to the application thereto of a compressive force to move said bearing portion and the remainder of said leaf in a direction toward the plane of said body, thereby resiliently stressing said leaf, j. the surface of said cavity on which said base seats preventing movement of said leaf in said direction beyond the plane of said body, k. said leaf being of substantially uniform thickness corresponding to that of said body and of varying width which narrows in a direction from said one end toward said bearing portion.

2. A shoe according to claim 1 wherein said leaf spirals from said one end toward said bearing portion.

3. A shoe according to claim 2 wherein the spiral of said leaf is nautiliform.

4. A shoe according to claim 2 wherein said spring member comprises two of said planar bodies so positioned relative to one another that the bearing portion of the leaf of one body confronts and seats on the bearing portion of the leaf of the other body.

5. A shoe according to claim 4 including means for securing the bearing portions of the respective leaves to one another.

6. A shoe according to claim 4 wherein said spring member has a fully compressed height corresponding to the combined thickness of said bodies.

7. A shoe according to claim 1 wherein said leaf terminates at said bearing portion.

8. A shoe according to claim 1 wherein said bearing portion of said leaf is enlarged relative to that part of said leaf which adjoins said bearing portion.

9. A shoe according to claim 1 wherein said body is circular in plan.

10. A shoe according to claim 1 wherein said body is quadrangular in plan.

11. A shoe according to claim 1 wherein said body has a second leaf cut from and integral with and joined at one end to said body at a zone spaced from the juncture of the first-mentioned leaf with said body.

12. A shoe according to claim 11 wherein said second leaf is joined at its other end to the first-mentioned leaf at said bearing portion.

13. A shoe according to claim 11 wherein said second leaf spirals and narrows in width from said one end toward its other end.

14. A shoe according to claim 13 wherein the spiral of each of said first and second leaves is nautiliform.

15. A shoe according to claim 13 wherein said second leaf is joined at its other end to the first-mentioned leaf at said bearing portion.

16. A shoe according to claim 1 including a plurality of said cavities each of which accommodates one of said spring members.

17. A shoe according to claim 16 wherein said cavities are spaced apart from one another in a direction lengthwise of said shoe.

18. A shoe according to claim 1 wherein said leaf is rectangular in cross-section and wherein the width of said leaf at all points between said one end and said bearing portion is greater than the thickness of said leaf.

19. A shoe according to claim 1 wherein said spring member has a compression range of about 0.27 inch.

* * * * *